US005493083A

United States Patent [19]

Olivier

[11] Patent Number: 5,493,083

[45] Date of Patent: Feb. 20, 1996

[54] ROTARY CONTROL DEVICE OF A CIRCUIT BREAKER

[75] Inventor: Bernard Olivier, Lumbin, France

[73] Assignee: Merlin Gerin, France

[21] Appl. No.: 191,121

[22] Filed: Feb. 3, 1994

[30] Foreign Application Priority Data

Feb. 16, 1993 [FR] France ..... 93 01824
Feb. 16, 1993 [FR] France ..... 93 01825

[51] Int. Cl.[6] ..... H01H 3/02

[52] U.S. Cl. ..... 200/17 R; 200/50 A; 200/330

[58] Field of Search ..... 200/17 R, 18, 200/50 A, 50 C, 573, 329–337; H01H 3/02, 3/10, 19/10, 19/14

[56] References Cited

U.S. PATENT DOCUMENTS

| | | | |
|---|---|---|---|
| 3,179,761 | 4/1965 | Malota et al. | 200/50 A |
| 3,911,235 | 10/1975 | Venzke et al. | 200/50 A |
| 3,970,808 | 7/1976 | Gryctko et al. | 200/50 A |
| 3,980,845 | 9/1976 | Gryctko et al. | 200/50 A |
| 4,011,423 | 3/1977 | Zepp | 200/50 A X |
| 4,151,385 | 4/1979 | Neuser et al. | 200/331 |
| 4,181,838 | 1/1980 | Neuser et al. | 200/573 |
| 4,612,424 | 9/1986 | Clark et al. | 200/50 A |
| 4,835,350 | 5/1989 | Ozu et al. | 200/50 A |
| 5,219,070 | 6/1993 | Grunert et al. | 200/330 |

FOREIGN PATENT DOCUMENTS

| | | | |
|---|---|---|---|
| 0522848 | 1/1993 | European Pat. Off. | H01H 9/22 |
| 684810 | 12/1939 | Germany | H01H 3/10 |
| 1893169 | 5/1964 | Germany | H01H 3/10 |
| 1951640 | 7/1971 | Germany | H01H 3/10 |
| 210783 | 6/1984 | Germany | H01H 3/02 |
| 446832 | 6/1936 | United Kingdom | H01H 19/14 |

*Primary Examiner*—J. R. Scott
*Attorney, Agent, or Firm*—Parkhurst, Wendel & Rossi

[57] ABSTRACT

A rotary control device for a circuit breaker having a front plate having an opening through which a crank pin extends, the crank pin being pivotal between first and second positions, the rotary control device including a housing and a rotary handle mounted on the housing, the rotary handle being rotatable between first and second positions corresponding to the first and second positions of the crank pin. A coupling mechanism is provided for mechanically coupling the rotary handle to the crank pin when the housing is mounted on the front plate of the circuit breaker, the connecting device preventing mounting of the rotary control device on the circuit breaker when the rotary handle and the crank pin are not in the same position, that is, are not both in the first position or both in the second position. The first and second positions may correspond to open and closed positions of the circuit breaker, for example.

11 Claims, 13 Drawing Sheets

ROTARY CONTROL DEVICE OF A CIRCUIT BREAKER

BACKGROUND OF THE INVENTION

The present invention relates to a rotary control device for a circuit breaker, notably a three-phase circuit breaker of industrial type, this circuit breaker comprising a front closing plate provided with an opening through which there passes a pivoting crank pin able to occupy at least two stable extreme positions, this device comprising a housing mounted on said front plate, a rotary handle securedly united to this housing and a mechanism to couple said handle and said crank pin.

State-of-the-art circuit breakers, and in particular three-phase industrial circuit breakers, are usually housed in cases whose front closing plate comprises an elongated opening through which there passes a pivoting crank pin which can occupy two stable positions corresponding respectively to opening and closing of the circuit breaker, and an intermediate middle position which indicates a fault. These cases are sometimes mounted in an electrical enclosure or switchboard equipped with a door. There exists an accessory which can be fitted on the front plate or on the door of the switchboard and which enables rocking of the crank pin to be controlled by means of a rotary handle. The drawback of state-of-the-art devices of this kind lies in the fact that they do not comprise efficient safety devices enabling assembly to be prevented when the two coupled control means, i.e. the crank pin and the rotary handle, are in disagreement.

SUMMARY OF THE INVENTION

A first object of the invention is to achieve a rotary control device of the crank pin of a circuit breaker guaranteeing agreement between the state of the circuit breaker and that of the rotary control device.

The coupling mechanism comprises for this purpose error prevention means arranged to prevent, fitting of said device when its state is in disagreement with that of the circuit breaker.

According to a preferred embodiment, said mechanism comprises a driving head movable in rotation with said rotary handle and a driving fork pivoting around a fixed spindle and mechanically coupled to said driving head by an eccentric pin borne by the latter and engaged in an oblong housing arranged in said driving fork, and said error prevention means comprise an opening arranged in said driving fork in which said crank pin of the circuit breaker is engaged when the circuit breaker and the rotary control device are in agreement of state, and a plate securedly affixed to said fork and bordering said opening at least partially.

According to a particularly advantageous alternative embodiment, it can comprise door locking means associated to said coupling mechanism.

Finally, according to another advantageous alternative embodiment, it can comprise locking means by a keylock, notably a barrel-type lock.

A development of the invention also relates to an extended rotary control for a circuit breaker, notably an industrial circuit breaker, comprising an operating spindle fitted between its rotary handle and its case.

Rotary control devices of this type are state-of-the-art. They do however have an important shortcoming due to the fact that the operating spindle, securedly coupled to the case, does not enable manufacturing clearances to be taken up and deviations on the manufacturing dimensions of electrical switchboards to be compensated for. Fitting of these control devices is sometimes made difficult and requires operations to be carried out to correct these clearances and/or deviations.

A second object of the invention is to achieve a rotary control device for a circuit breaker enabling alignment faults due to gravity and deviations on switchboard dimensions to be compensated for.

The extended rotary control comprises for this purpose a flexible device for recentering the operating spindle, and a sleeve which performs mechanical coupling between the operating spindle and a driving head of the case.

According to this embodiment, said sleeve comprises a first appreciably cylindrical section which is housed with clearance in a frustum-shaped central recess of the driving head.

Said first section advantageously comprises a toothed wheel arranged at the periphery of a zone of its end and said driving head also comprises a toothed wheel, these two toothed wheels being arranged to intermesh with clearance.

BRIEF DESCRIPTION OF THE DRAWINGS

Other advantages and features of the present invention will become more clearly apparent from the following description of a preferred embodiment of the invention, given as a nonrestrictive example only and represented in the different phases of its operation by the accompanying drawings in which:

FIGS. 2A, 2B, 2C and 2D represent axial sectional views illustrating operation of the error prevention means of the coupling mechanism of FIG. 2, wherein FIG. 2A represents the circuit breaker and the rotary control device in open positions, FIG. 2B represents the circuit breaker in the open position and the rotary control in the closed position, FIG. 2C represents the circuit breaker in the closed position and the rotary control device in the closed position, and FIG. 2D represents the circuit breaker in the closed position and the rotary control device in the open position, FIGS. 3A, 3B, 3C 3D and 3E represent partial views of the device according to the invention illustrating the device for locking the door of an electrical switchboard containing a circuit breaker, wherein FIGS. 3C and 3D represent door closed and door open positions, respectively, FIGS. 4A, 4B, 4C and 4D illustrate operation of the locking means by a keylock of the coupling mechanism of the device according to the invention, wherein FIG. 4A shows the locking means in a closed unlocked position, FIG. 4B shows the locking means in a closed locked position, FIG. 4C shows the locking means in an open unlocked position, and FIG. 4D shows the locking means in an open locked position.

DETAILED DESCRIPTION OF THE PREFERRED EMBODIMENT

Figure 1:
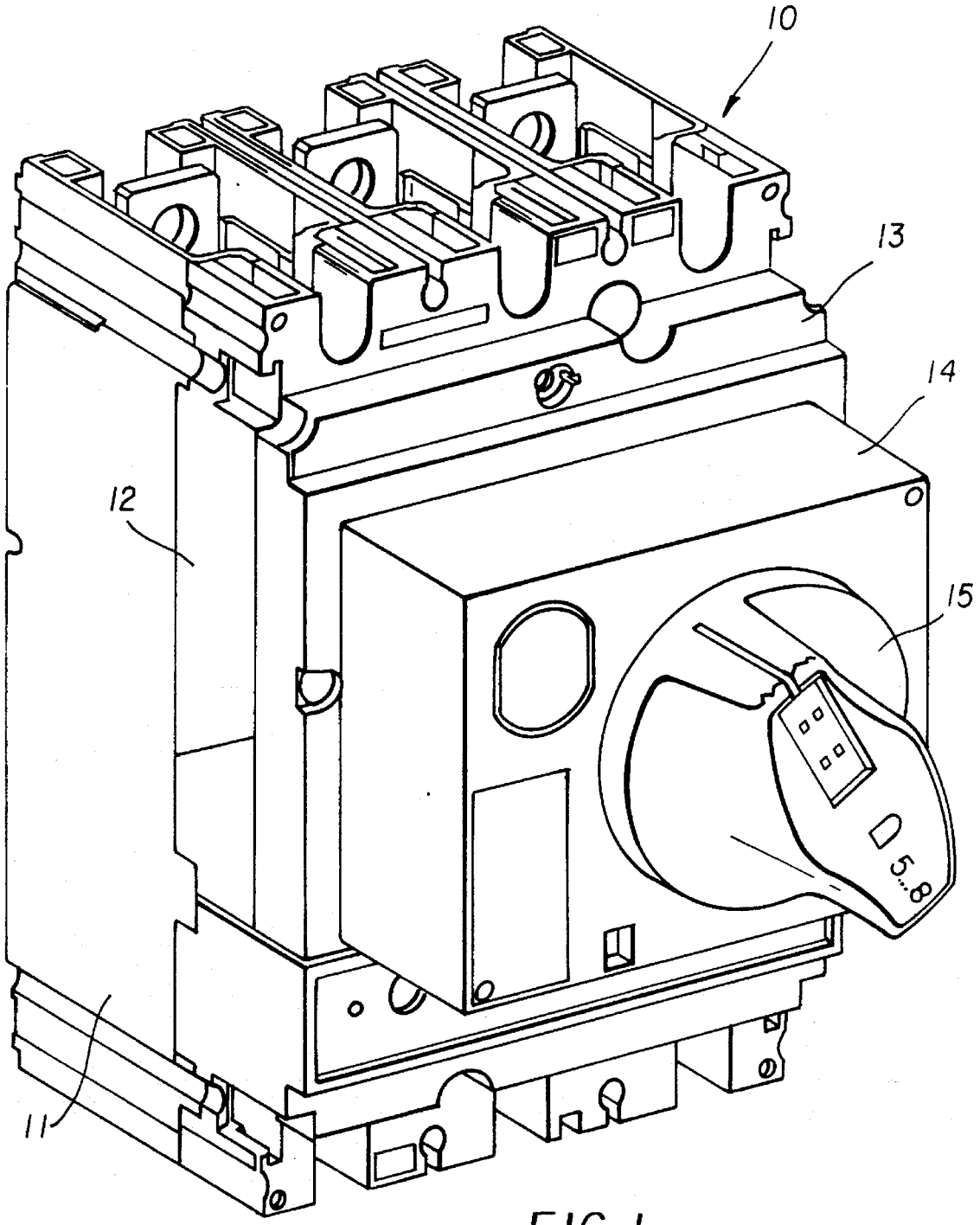
FIG. 1 is a perspective view of a circuit breaker equipped with a rotary control device according to the invention, FIGS. 1A, 1B and 1C respectively represent three positions of the handle of the device according to the invention, these positions corresponding to open, tripped on fault, and closed states of the circuit breaker.

FIG. 1 represents a perspective view of a circuit breaker 10 whose case 11 is closed on its front face by a front plate 12 on which a rotary control device 13 is mounted. This device comprises a housing 14 which contains a coupling mechanism between a pivoting crank pin of the circuit breaker and a rotary handle 15 fitted to the front of this housing. Each position of the handle corresponds to a position of the crank pin and to a state of the circuit breaker.

Figure 1A:
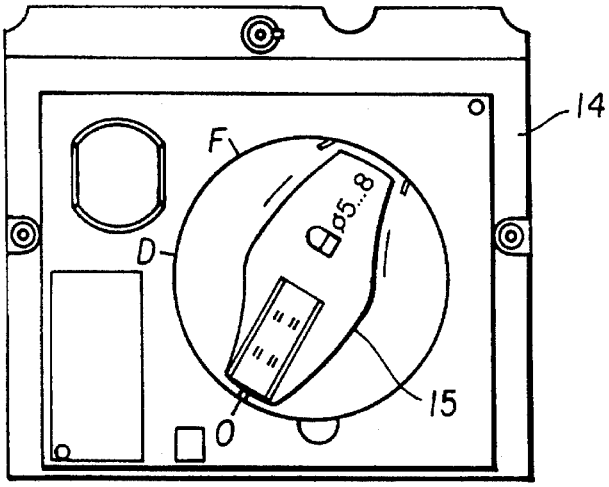
Figure 1B:
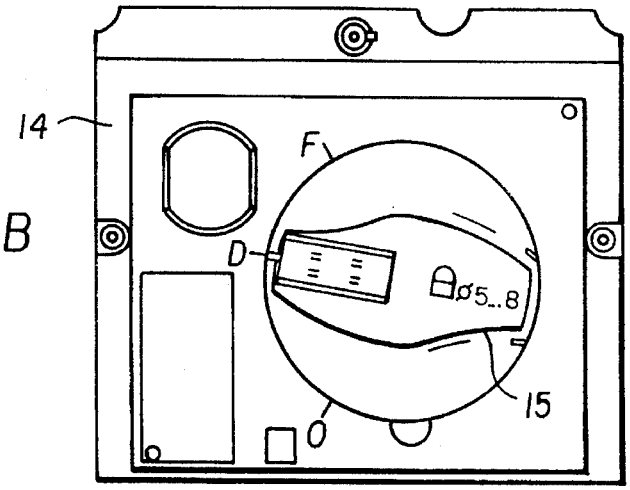
Figure 1C:
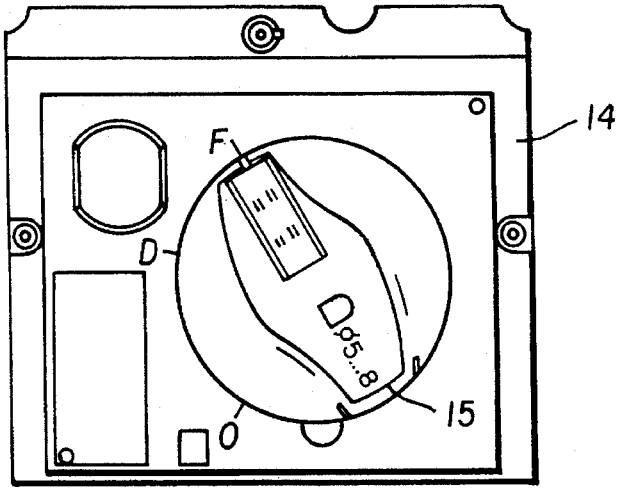

FIGS. 1A, 1B and 1C respectively represent three positions of the handle corresponding to three states of the circuit breaker. In the position represented by FIG. 1A, the circuit breaker is in its open state. The handle 15 is facing the mark O of the front face of the housing 14. In the position represented by figure 1B, the circuit breaker is in its tripped on fault state. The handle 15 is facing the mark D of the front face of the housing 14. In the position represented by FIG. 1C, the circuit breaker is in its closed state. The handle 15 is facing the mark F of the front face of the housing 14. A single position of the crank pin corresponds to each of these positions of the handle.

Figure 2:
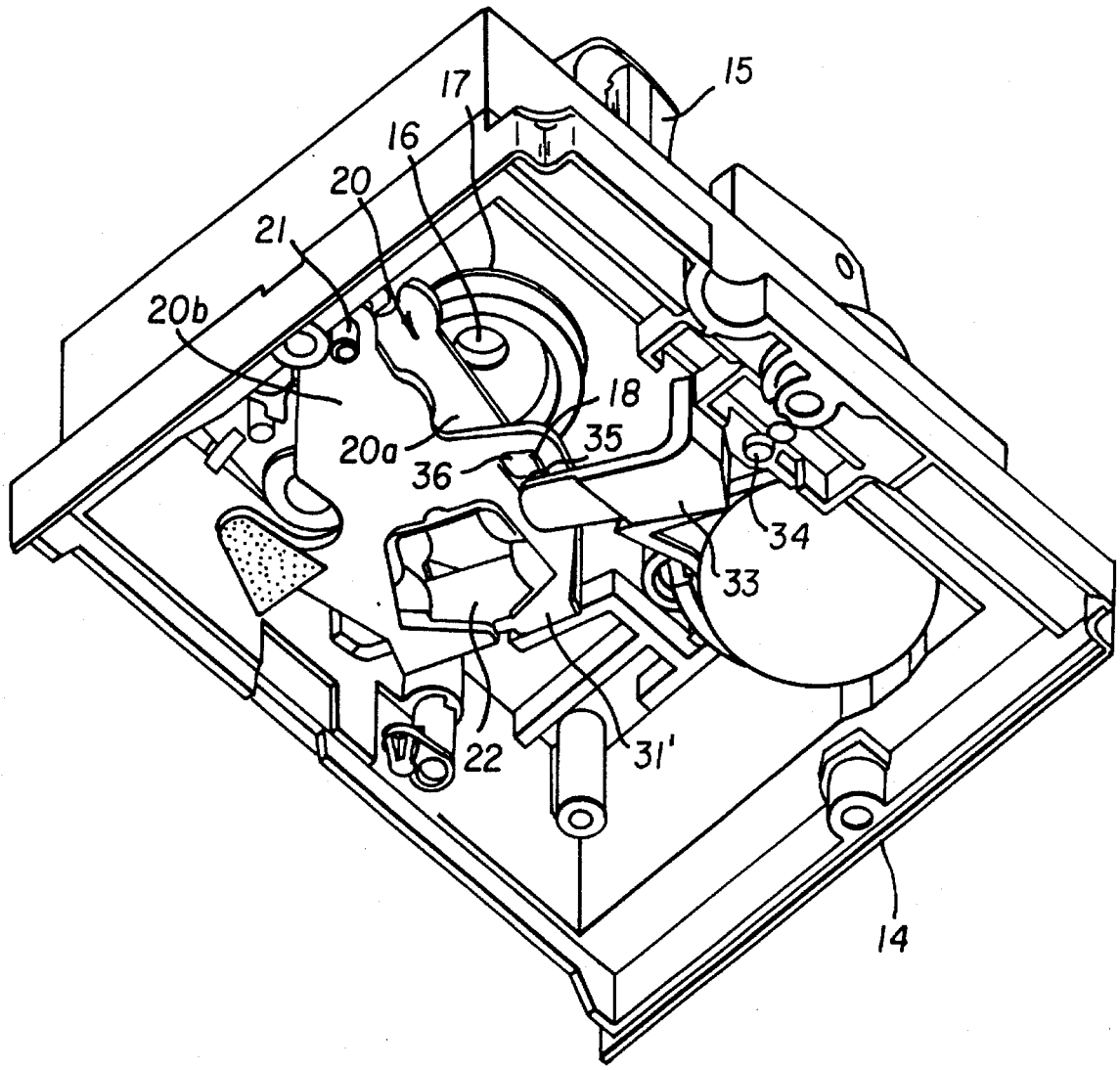
FIG. 2 represents a bottom view in perspective representing the coupling mechanism between the circuit breaker crank pin and the rotary handle of the device according to the invention.

FIG. 2 represents a perspective view illustrating the coupling mechanism housed in the housing 14. The handle 15 is mounted on a spindle 16 and is securedly united to a driving head 17 which bears an eccentric pin 18 engaged in an oblong housing 19 of a driving fork 20 pivoting around a fixed spindle 21 securedly affixed to the housing 14. The driving fork 20 comprises a first part **20*a* which cooperates with the eccentric pin 18 and a second part 20*b* mounted parallel to the first part and securedly attached thereto. The part 20*b* comprises an opening 22** in which the crank pin of the circuit breaker is engaged.

Due to these components, rotation of the handle causes rotation of the driving head 17 and of the eccentric pin 18 which it bears. The eccentric pin therefore makes the driving fork 20 pivot by acting on said first part **20*a* of this fork. As the first part 20*a* and the second part 20*b* of this driving fork are securedly attached, they pivot simultaneously in a plane perpendicular to the spindle 21. The opening 22** defines a housing in which the crank pin is engaged being subjected to a thrust from the walls surrounding the opening and therefore rocking to one or the other of the positions defined with reference to figures 1A, 1B and 1C.

This mechanism is constructed in such a way that the rotary control device can only be fitted if the crank pin and handle are in agreement of states. FIGS. 2A, 2B, 2C and 2D represent sectional views illustrating the different cases which may arise when fitting the rotary control device on the front plate of a circuit breaker.

Figure 2A:
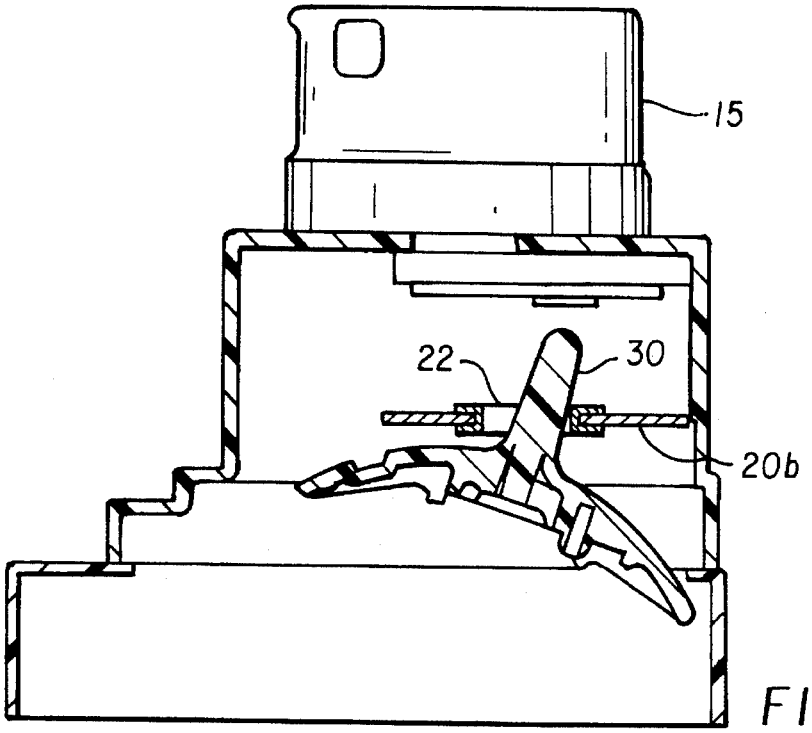

In the case of FIG. 2A, the handle 15 is on the mark O, which corresponds to the open position of the device. The crank pin 30 of the circuit breaker is also in the position corresponding to the open state of the circuit breaker. The opening 22 of the part **20*b* of the driving fork 20** is therefore in a position such that this crank pin can be freely engaged therein.

Figure 2B:
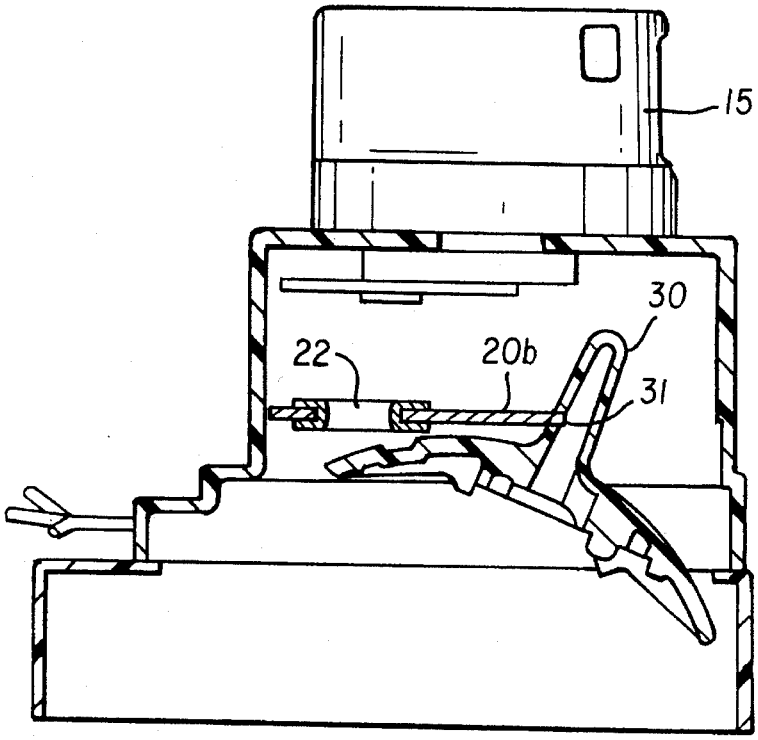

In the case of FIG. 2B, the handle 15 is on the mark F, which corresponds to the closed position of the device. The crank pin 30 is in the same position as before, which corresponds to the open state of the circuit breaker. The opening 22 is offset with respect to the position occupied before. Consequently, the crank pin 30 cannot be engaged in this opening. An interference zone 31 exists between the part **20*b* and the crank pin 30, preventing the rotary control device from being fitted when there is a disagreement of states between the circuit breaker and its rotary control expressed by a disagreement of position between the crank pin and handle. This interference zone 31 is formed by an error prevention plate 31' forming an integral part of the part 20*b* and bordering one side of the opening 22**.

Figure 2C:
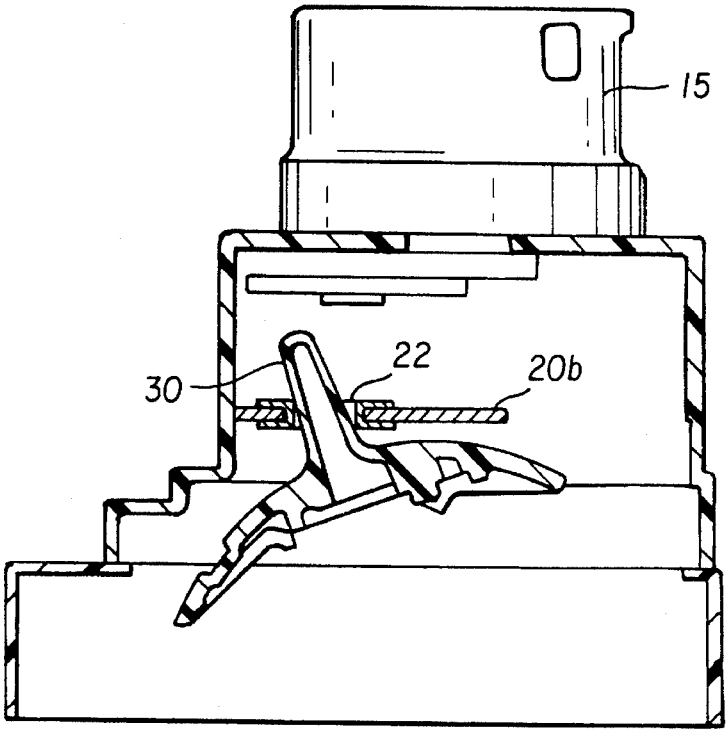

In the case of FIG. 2C, the handle 15 is on the mark F, which corresponds to the closed position of the device. The crank pin 30 is also in the position corresponding to the closed state of the circuit breaker. The opening 22 of the pare **20*b* of the driving fork 20** is therefore in a position in which it is able to accommodate this crank pin. There is agreement of position due to the agreement of states.

Figure 2D:
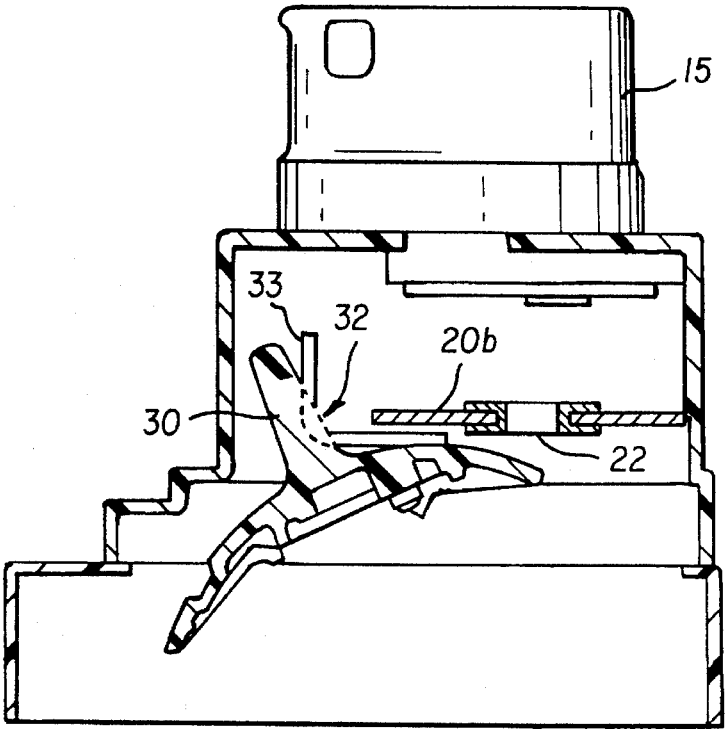

In the case of FIG. 2D, the handle 15 is on the mark O, which corresponds to the open position of the device. The crank pin 30 is in the position corresponding to the closed state of the circuit breaker. The opening 22 is therefore offset with respect to the position which would enable the crank pin to be inserted. An interference zone 32 exists between the crank pin and a strip 33, represented in FIG. 2, of flanged shape pivoting around a spindle 34 and coupled to said driving fork by a pin 35 engaged in an oblong opening 36 of the part **20*b***, this strip preventing the rotary control device from being fitted. This fitting is again prevented when there is a disagreement of states.

This set of components which cooperate to enable the rotary control device to be fitted when there is agreement of states and to prevent this fitting when there is disagreement, constitutes an error prevention system.

The rotary control device is further equipped with door locking means arranged to enable a door of an enclosure inside of which a circuit breaker is fitted to be locked if required. These means are illustrated by FIGS. 3A, 3B, 3C, 3D and 3E. They comprise a latch 40 pivoting around a fixed spindle 41 and provided at one of its ends with a nose 42 arranged to cooperate with a stop 43 securedly affixed to the driving head 17 securedly affixed to the rotary control handle. The other end of the latch 40 comprises a stop 44 arranged to cooperate with a hook 45 securedly affixed to said door of the enclosure containing the circuit breaker.

Figure 3A:
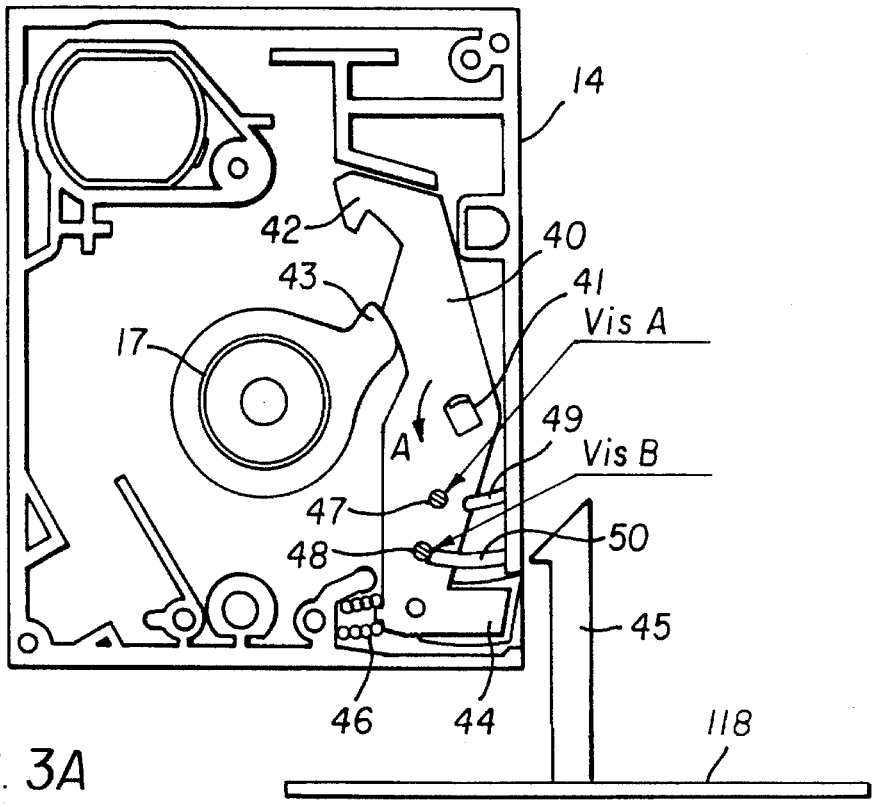
Figure 3B:
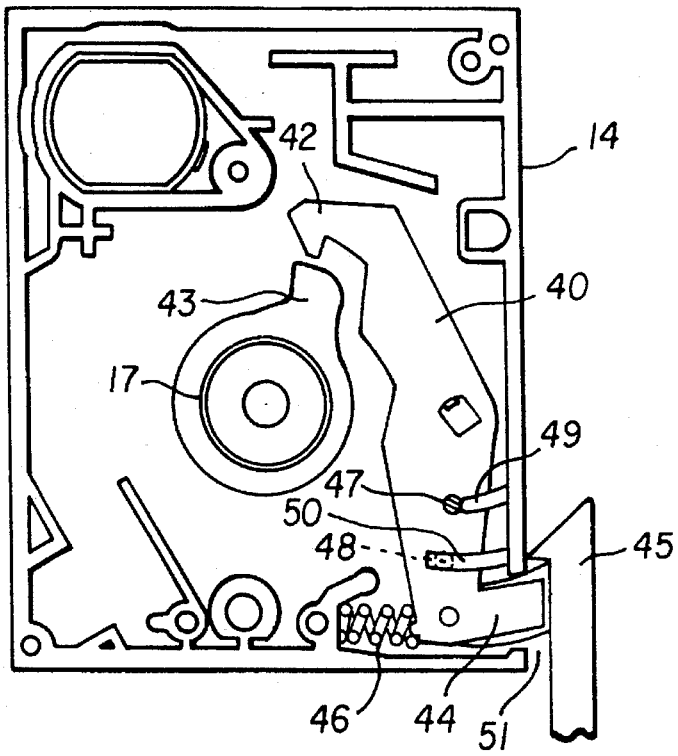
Figure 3C:
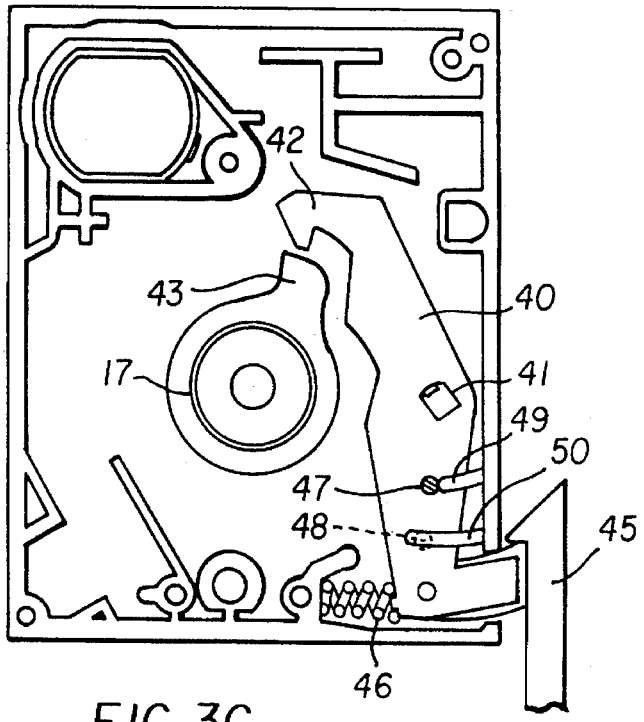
Figure 3D:
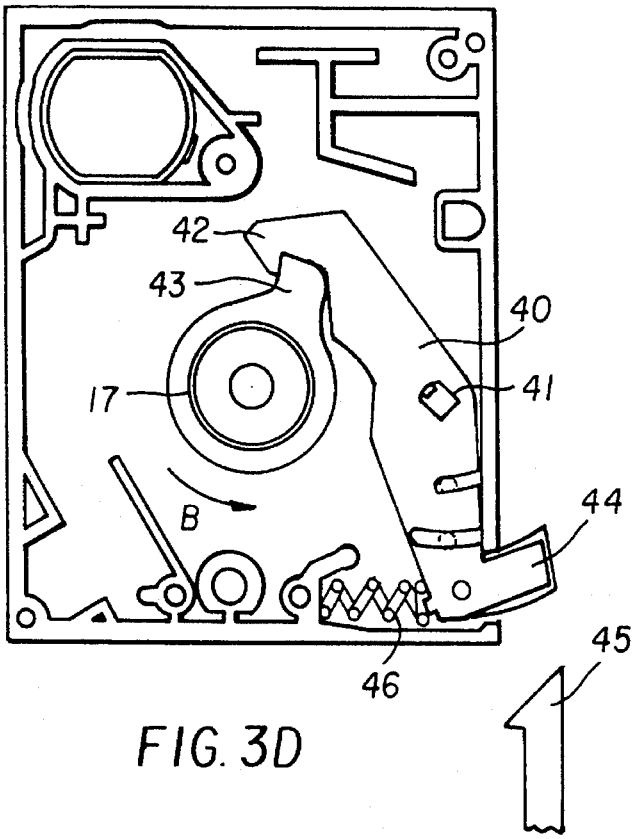

The latch 40 is permanently biased by a compression spring 46 which tends to make it rock in the direction of the arrow A to a position represented by FIG. 3D.

Door locking is an optional function which can be implemented or not by the final user. For this purpose, the latch 40 can be equipped with two screws 47 and 48 arranged to cooperate, if required, with two fixed stops 49 and 50 securedly affixed to the housing 14 of the rotary control device.

In the example illustrated by FIG. 3A, the screw 48 is pressing against the stop 50 and prevents the latch 40 from rocking in the direction of the arrow A. The stop 44 remains inside the housing 14 and the nose 42 does not interfere with the circular trajectory of the stop 43 when the handle is turned. There is therefore neither door locking nor locking of the handle.

In the example illustrated by FIG. 3B, the screw 48 has been removed, but the screw 47 remains in place. Due to the effect of the compression spring 46, the latch 40 has rocked in such a way that the screw 47 is pressing against the stop 49. The stop 44 is engaged in an opening 51 of the housing 14 and cooperates with the hook 45 to lock the door of the circuit breaker enclosure. The screw 47 and stop 49 on the other hand prevent complete rocking of the latch 40 and therefore preserve a clearance between the nose 42 and stop 43. In this case, the door locking function is implemented, but not the handle locking function.

When the two screws 47 and 48 are removed, complete pivoting of the latch 40 is theoretically possible. In practice, there are however three distinct cases illustrated respectively by FIGS. 3C, 3D and 3E.

In the case of FIG. 3C, the hook 45 of the enclosure door has the same function as the screw 47 associated to the stop 49, since it prevents complete rocking of the latch 40. This hook 45 is in fact in the position represented when the enclosure door is closed. It acts as a stop preventing complete pivoting of the latch 40 and serves the purpose of preserving a clearance between the nose 42 and stop 43 to allow free rotation of the handle coupled to the driving head 17. In other words, when the enclosure door is closed, the rotary control handle can be actuated freely.

In the case of FIG. 3D, the enclosure door is open and the hook 45 does not oppose complete pivoting of the latch 40. The nose 42 positions itself against the stop 43 and prevents rotation of the driving head 17 in the direction of the arrow B. Consequently, when the enclosure door is opened, operation of the handle of the rotary control device is prevented.

Figure 3E:
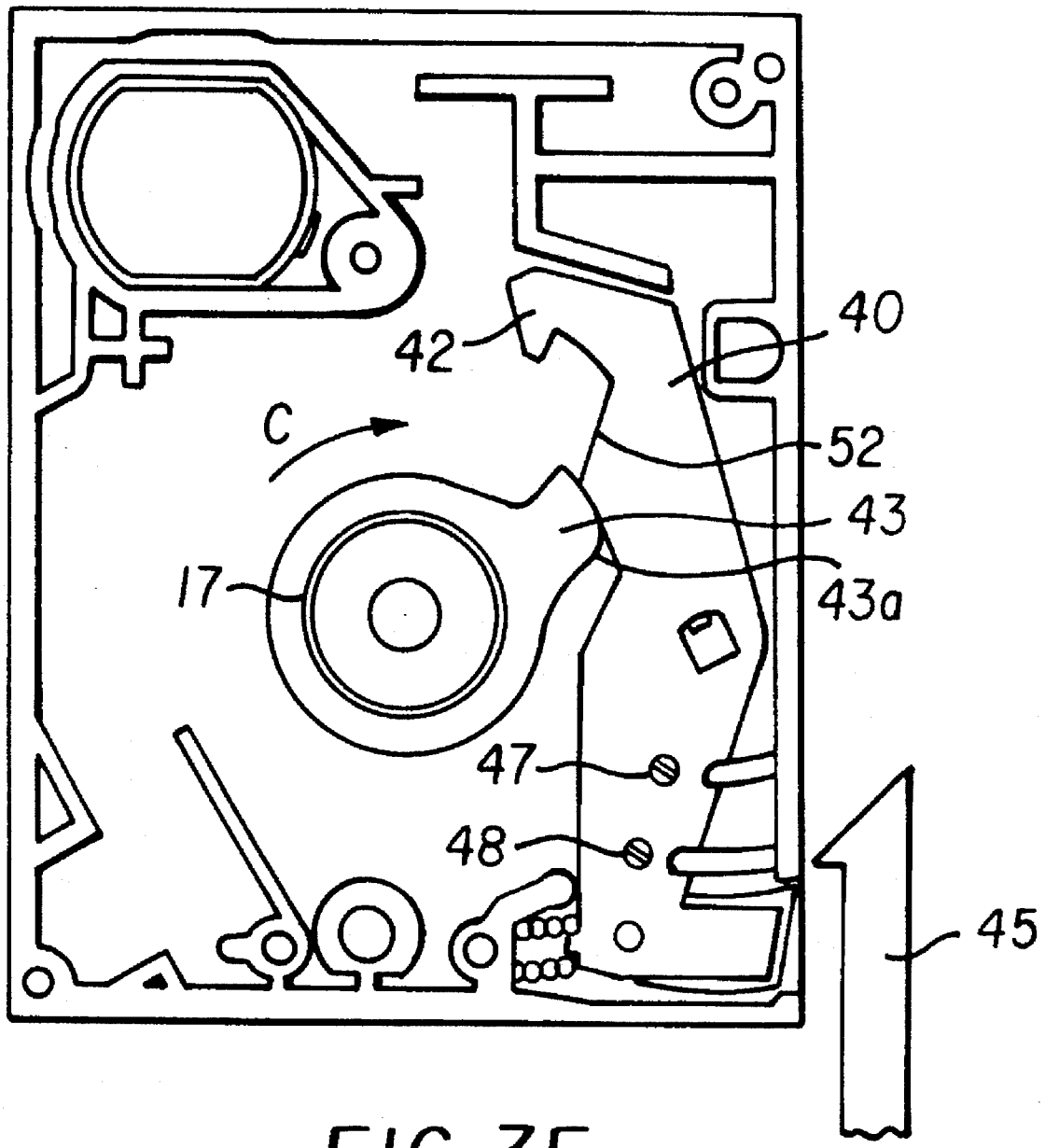

FIG. 3E shows that the enclosure door can only be opened if the circuit breaker is in the open position, when the two screws 47 and 48 have been removed. Initially, the moving parts are in the position represented by FIG. 3D. When the operator turns the handle in the direction of the arrow C, the stop 43 of the driving head 17, which comprises a rounded edge **43*a*, cooperates with a ramp 52 arranged on the edge of the latch 40, at the rear of the nose 42, to make this latch rock and release the door hook 45**. Rotation of the handle in the direction of the arrow C corresponds to an operation tending to move this handle to the open position of the circuit breaker.

In addition to error prevention and door locking, the device can be provided with means for keylocking. Implementation of this complementary function is described with reference to FIGS. 4A, 4B, 4C and 4D. A barrel-type lock 60 is fitted inside the enclosure 14. This lock comprises a rotary bolt 61 which is arranged to cooperate with the part **20*b*** of the driving fork.

Figure 4A:
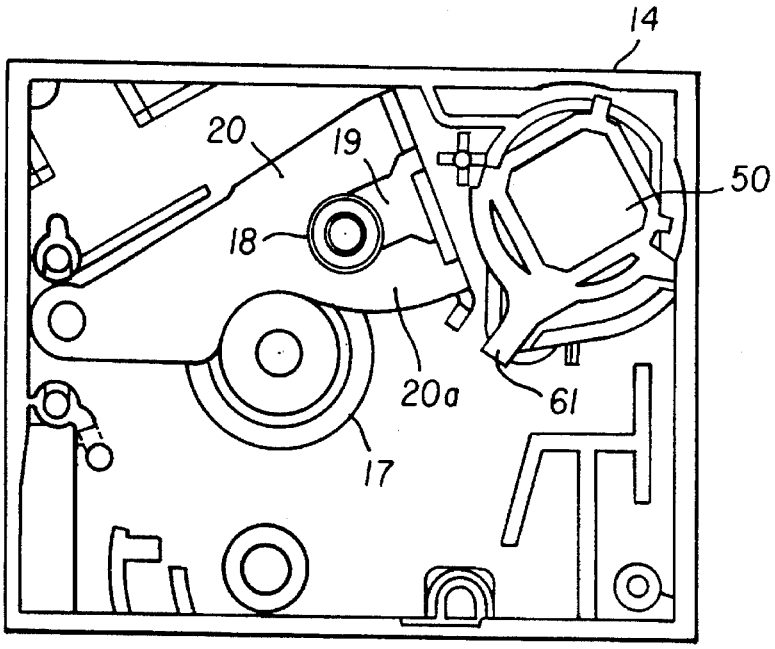

FIG. 4A represents the keylock 60 in the unlocked position, the rotary control device being in the closed position which corresponds to the closed state of the circuit breaker.

Figure 4B:
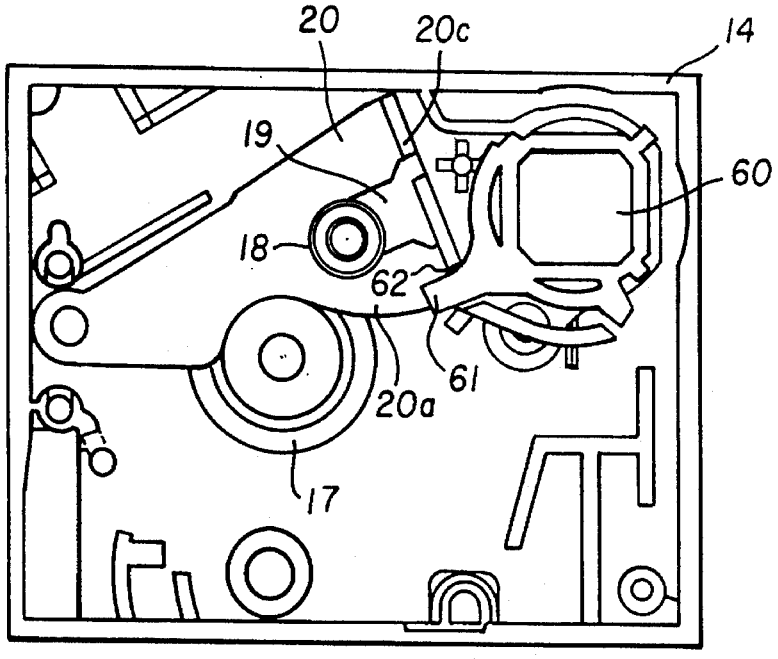

FIG. 4B represents the keylock 60 in the locked position, the rotary control device still being in the closed position. The bolt 61 is engaged in a notch 62 arranged in the driving fork, more exactly in a part 20C joining the two parts **20*a* and 20*b*, perpendicularly to the latter. It prevents rotation of the driving head 17 since the part 20*a* is blocked and blocks the eccentric pin 18**.

Figure 4C:
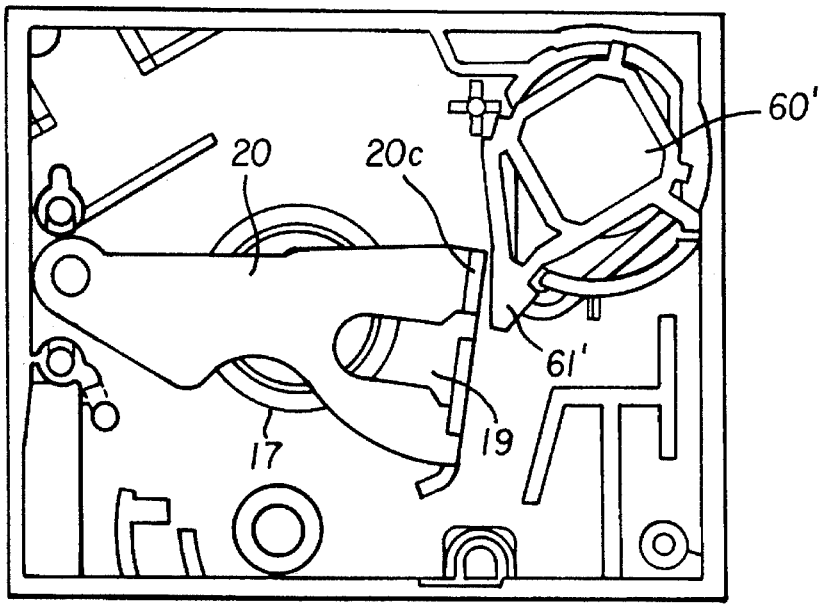
Figure 4D:
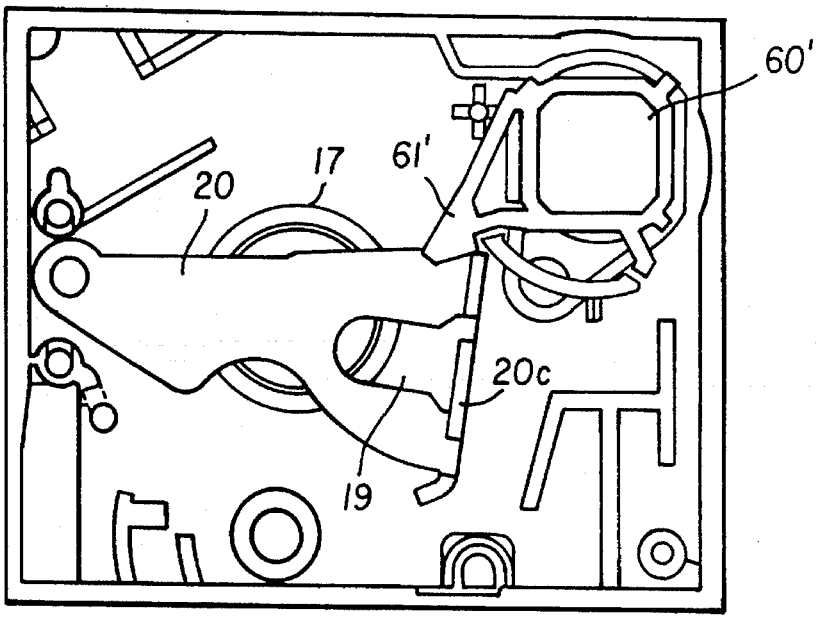

FIGS. 4C and 4D illustrate operation of the keylock when the rotary control device is in the open position. A barrel-type lock 60', which could be identical to the lock 60 represented by FIGS. 3A and 3B, comprises a bolt 61'. In both cases, the rotary control device is in the open position. In the example of FIG. 4C, the lock 60' is open and the bolt 61' does not interfere with the trajectory described by the part 20C of the driving fork 20 when the driving head 17 is operated.

In the example of FIG. 4D, the lock 60' is closed and the bolt 60" blocks the part 20C and prevents rotation of the driving head 17.

It is well understood that blocking of the driving head by the bolt could be achieved by different means from pressing of this bolt against the part 20C. The bolt could, for example, cooperate with either of the parts **20*a* or 20*b***.

Figure 5:
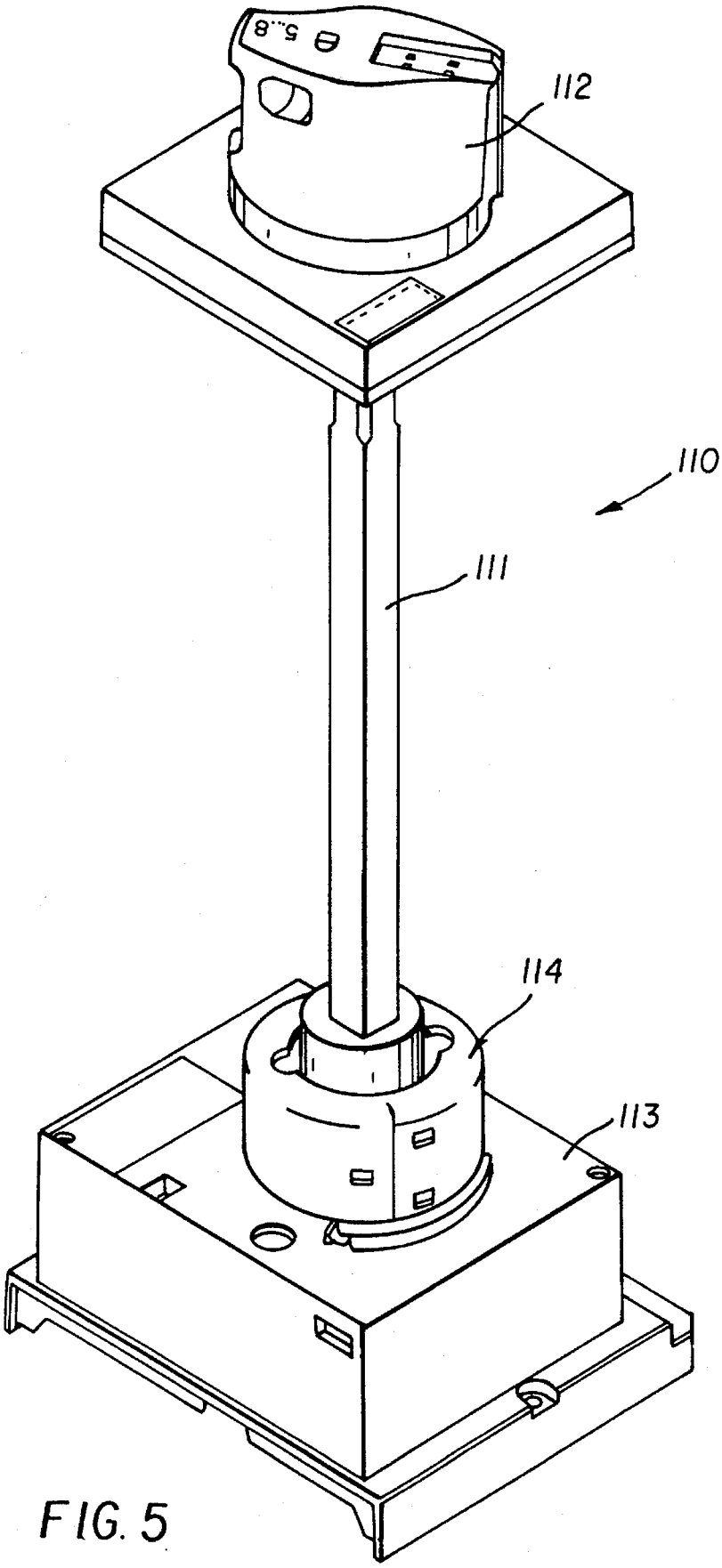
FIG. 5 is a perspective view of the extended rotary control.

With reference to FIG. 5, the extended rotary control 110 comprises an operating spindle 111, a rotary handle 112 mounted on the free end of this spindle, and a casing 113 to which the operating spindle ill is coupled, at its other end, by means of a flexible centering device 114.

Figure 6A:
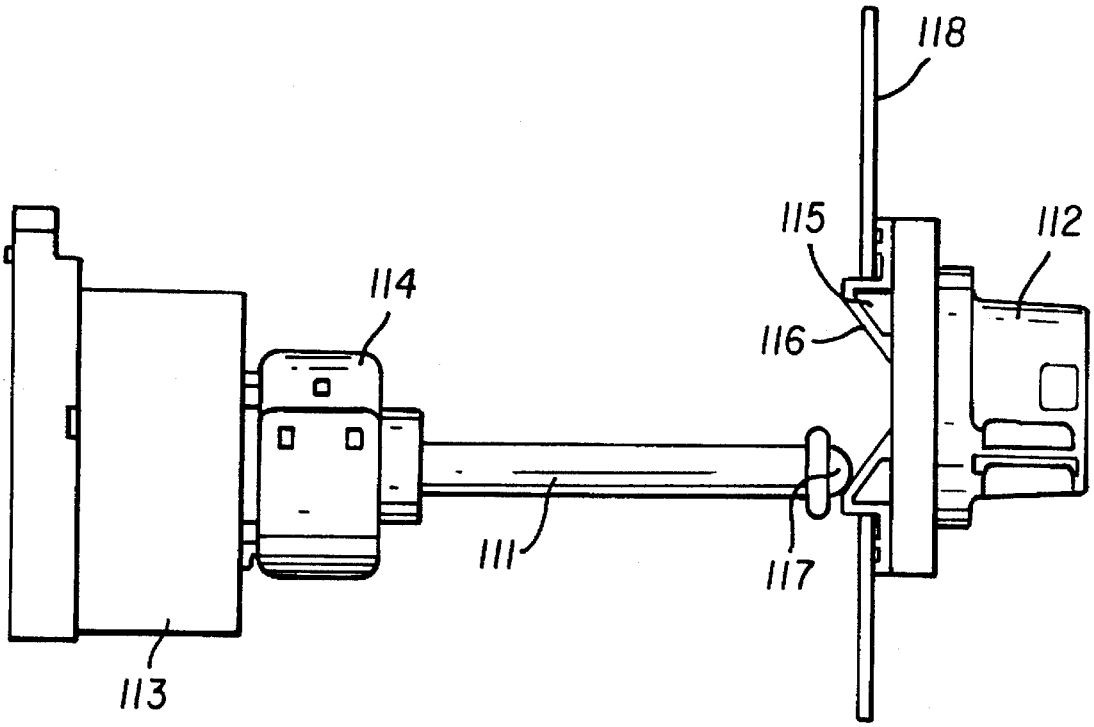
FIG. 6A represents a schematic view of the control of FIG. 5 at the beginning of the closing phase of a door on which the rotary handle is mounted.
Figure 6B:
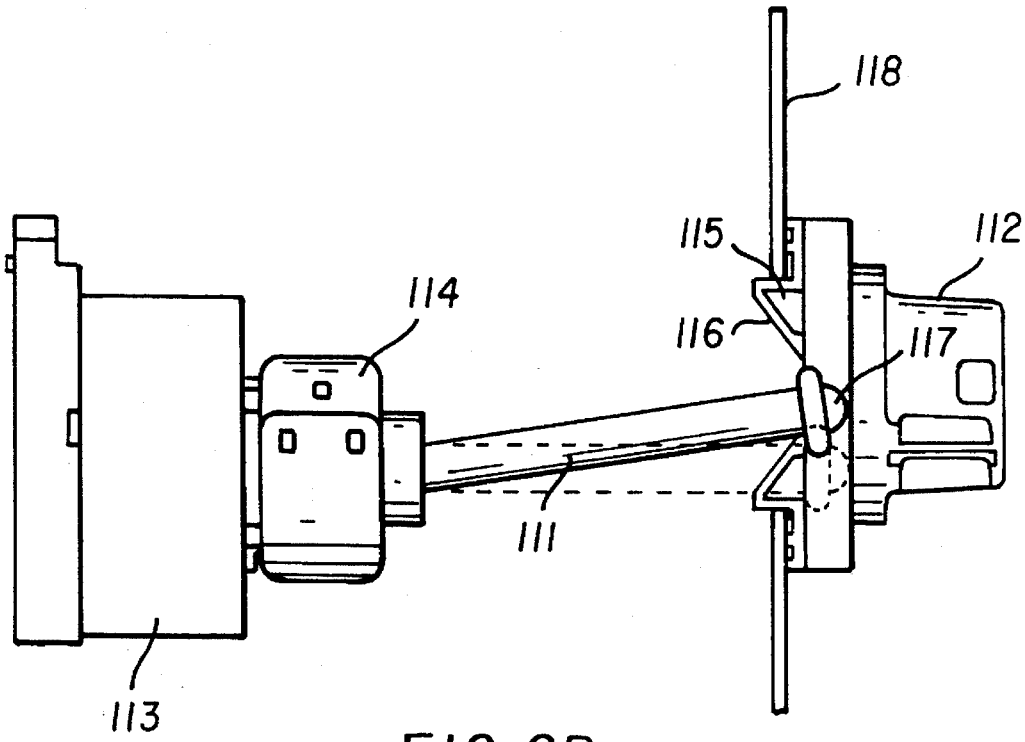
FIG. 6B represents a similar view to that of FIG. 6A at the end of the closing phase of said door.

As shown by FIGS. 6A and 6B, the handle 112 is associated to a centering ring 115 which comprises a conical internal surface 116 defining a circular ramp on which the rounded end 117 of the operating spindle 11 bears, at the beginning of the closing phase (see FIG. 6A) of a door 118 on which said handle 112 is mounted.

In the course of closing of this door, the end 117 slides on the conical internal surface 116 of the centering ring 115 to position itself approximately centered as shown by FIG. 6B. This angular movement of the operating spindle is made possible by the flexibility of the flexible recentering device 114 whose manufacture will be described in detail with reference to the following figures.

The flexible recentering device 114 is coupled to a driving head 119 of the casing 113, which is provided with a frustum-shaped central recess 120. This device in addition comprises a sleeve 121 comprising a first appreciably cylindrical section 122, of small cross-section, and a second appreciably cylindrical section 123, of large cross-section. The first section 122 is engaged in the frustum-shaped central recess 120 of the driving head 119 to which it is secured by a screw 124 screwed into a threaded bore 125 disposed axially and arranged in said first section 122 and having a widened head 126 which presses on the edges 127 of a circular recess 128 provided in the driving head, on the opposite side from the frustum-shaped recess 120.

The second section 123 comprises a recess of polygonal cross-section, for example square, arranged to receive one end of the operating spindle 111.

Due to the clearance provided between the external wall of said first section 122 of the sleeve 121 and the internal wall of the frustum-shaped central recess 120 of the driving head 119, the operating spindle 111 can move angularly as shown in FIG. 6B.

To move the operating spindle 111 automatically to a centered position, a compression spring 129 is fitted between an edge 130 of the sleeve 121 and a bearing ring 131 mounted coaxially on the driving head. A protective shell 132 covers this assembly. The spring has the effect of generating a thrust tending to move the sleeve 121 away from the driving head. As these two parts are linked by the screw 124, this separation movement is counteracted and the effect obtained is a recentering of the sleeve with respect to the driving head, when the operating spindle is released after undergoing an angular movement.

Figure 7A:
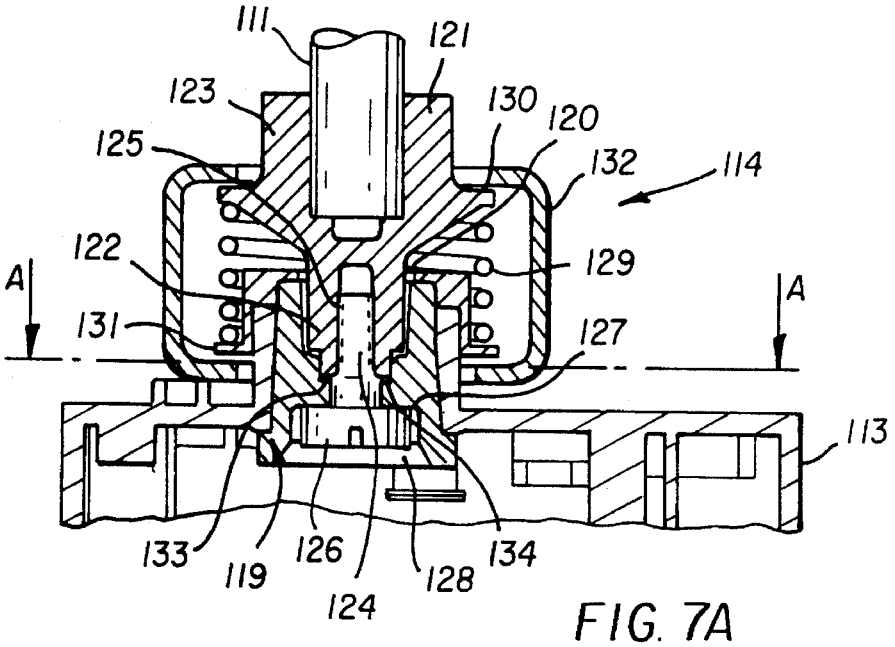
FIG. 7A is a cross-sectional view of the flexible recentering device in the position corresponding to the beginning of the closing phase of said door.
Figure 7B:
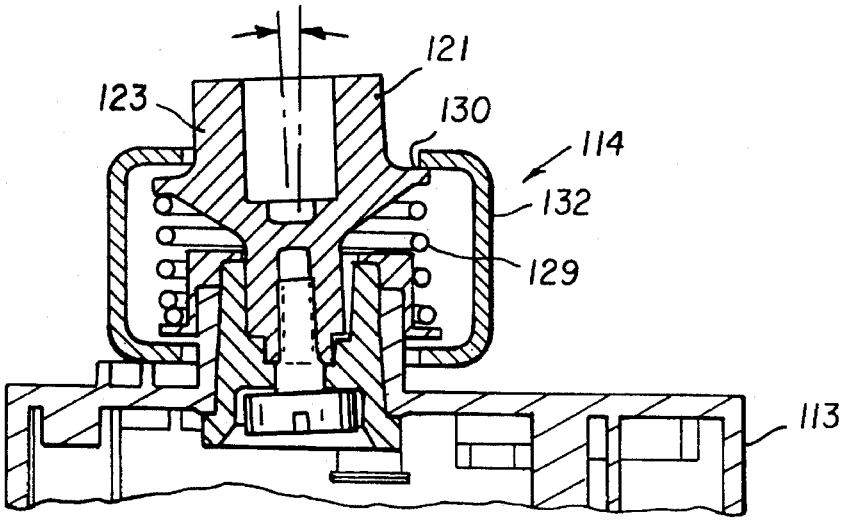
FIG. 7B is a similar view to that of FIG. 7A at the end of the closing phase of said door.
Figure 8:
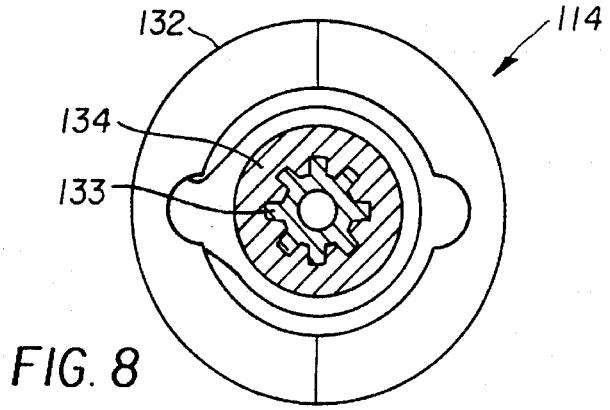
FIG. 8 is a top view of the flexible recentering device.

Rotation of the driving head is obtained by means of a first toothed wheel 133 arranged at the periphery of the end zone of the first section 122 of the sleeve 121, which cooperates with a second toothed wheel 134, arranged at the bottom of the frustum-shaped central recess 120 (FIGS. 7A and 7B).

A relatively large clearance is provided between the two toothed wheels so that they remain engaged even when the operating spindle is angularly offset.

Consequently, due to the different clearances, the operating spindle can be shifted angularly, while still remaining coupled to the driving head. Due to the compression spring, the operating spindle tends to position itself according to an axial direction as soon as it is released by opening of the switchboard door, after undergoing an angular shift, and can resume its offset position when this door is closed.

I claim:

1. A rotary control device for a circuit breaker including a front plate having an opening through which a crank pin extends, the crank pin being pivotal between first and second positions, said rotary control device comprising:

a housing;

a rotary handle mounted on said housing, said rotary handle being rotatable between first and second positions corresponding to the first and second positions of the crank pin of the circuit breaker, respectively; and coupling means for mechanically coupling the rotary handle to the crank pin wherein said housing is mounted on the front plate of the circuit breaker, said coupling means being provided in said housing and being connected to said rotary handle, said coupling means preventing mounting of the rotary control device on the circuit breaker when the rotary handle and the crank pin of the circuit breaker are not in the same position, and said coupling means comprising a driving head provided in the housing and being connected to the rotary handle such that said driving head is rotatable with said rotary handle, a pin extending from the driving head, a driving fork pivotally mounted on a fixed spindle in said housing, said pin engaging said driving fork to rotate the driving fork about said fixed spindle via rotation of the driving head, said driving fork having an opening therein for receiving the crank pin of the circuit breaker when the rotary control device is mounted on the front plate of the circuit breaker.

2. The rotary control device of claim 1, wherein said driving fork comprises a first part and a second part secured to each other and extending parallel to each other, said opening being provided in the second part.

3. The rotary control device of claim 2, wherein said first part includes an oblong recess for receiving said pin.

4. The rotary control device of claim 1, wherein said coupling means further comprises a strip secured to and extending from said driving fork, at least one of said driving fork and said strip abutting the crank pin to prevent mounting of the rotary control device on the circuit breaker when the rotary handle and the crank pin of the circuit breaker are not in the same position.

5. The rotary control device of claim 1, further comprising door locking means including a pivotal latch provided in said housing, the latch having a locking protrusion and said housing having a window therein, said door locking means further including a biasing spring for biasing the latch to pivot such that the locking protrusion extends through the window.

6. The rotary control device of claim 5, wherein said door locking means further includes a first stop and a first removable screw extending from the latch, the first removable screw preventing pivoting of the latch by abutting the first stop.

7. The rotary control device of claim 6, wherein the latch further includes a locking nose and the driving head further includes a locking arm, the locking nose being adapted to abut the locking arm to prevent rotation of the driving head, said door locking means further including a second stop and a second removable screw extending from the latch, the second removable screw abutting the second stop to prevent rotation of the latch such that the locking nose abuts the locking arm.

8. The rotary control device of claim 1, further comprising a keylock having a barrel for locking the driving fork.

9. A rotary control device for a circuit breaker, comprising:

a casing having a driving head secured thereto, said driving head having a frustrum-shaped central bore having an internal end that has teeth;

an operating spindle having first and second opposite ends, said first end being mechanically coupled to said driving head to rotate said driving head, said second end being mechanically coupled to a rotary drive handle for rotating said operating spindle; and a recentering device connecting the first end of the operating spindle to said driving head, said recentering device comprising a sleeve having a first cylindrical portion received in the frustrum-shaped central bore of the driving head, said first cylindrical portion having an external end that has conjugate teeth which engage the teeth of the internal end of the central bore of the driving head.

10. The rotary control device of claim 9, wherein said recentering device further comprises a screw for securing said sleeve to said driving head, and a compression spring abutting the sleeve, to bias said sleeve to a centered position in the frustrum-shaped central bore of the driving head, said sleeve further comprising a second cylindrical portion extending from the first cylindrical portion, said second cylindrical portion including an internal bore having a polygonal cross-section, said internal bore receiving said first end of the operating spindle.

11. The rotary control device of claims 10, further comprising a protective shell covering said compression spring.

* * * * *